United States Patent [19]

Dremann

[11] 4,075,789

[45] Feb. 28, 1978

[54] ABRASIVE BLAST SYSTEM HAVING A MODULATION FUNCTION

[76] Inventor: George H. Dremann, 1940 Hopkins St., Berkeley, Calif. 94707

[21] Appl. No.: 706,510

[22] Filed: Jul. 19, 1976

[51] Int. Cl.[2] ..... B24C 3/00

[52] U.S. Cl. ..... 51/436; 51/438

[58] Field of Search ..... 51/8, 11, 12; 251/25, 251/47

[56] References Cited

U.S. PATENT DOCUMENTS

| | | | |
|---|---|---|---|
| 3,070,924 | 1/1963 | Hastrup | 51/12 |
| 3,199,844 | 8/1965 | Moore et al. | 51/12 |
| 3,201,901 | 8/1965 | Pauli | 51/12 |
| 3,834,082 | 9/1974 | Grudzinski | 51/12 |

*Primary Examiner*—Robert C. Watson
*Attorney, Agent, or Firm*—Bruce & McCoy

[57] ABSTRACT

An abrasive blast system comprised of an abrasive media holding tank, a pressurized air supply, a remotely controllable inlet and outlet valve means for pressurizing and depressurizing said holding tank, a remotely controllable abrasive flow control valve capable of modulating the flow of the abrasive blasting media, and a remote control valve disposed to be operated by the operator of the abrasive blast system for remotely controlling the inlet and outlet valve means, as well as the abrasive flow control valve.

33 Claims, 11 Drawing Figures

ABRASIVE BLAST SYSTEM HAVING A MODULATION FUNCTION

BACKGROUND OF THE INVENTION

1. FIELD OF INVENTION

The present invention relates to methods and equipment for blasting with abrasive media, and more particularly to a method and system for controlled abrasive blasting including an improved pneumatic valve system for remotely activating and modulating the flow of abrasive media from the apparatus's abrasive media holding tank. The invention also relates to air blasting equipment in that it provides a single apparatus capable of both air blasting and abrasive blasting.

2. BACKGROUND OF THE PRIOR ART

Blasting with abrasive media has a wide variety of applications. These include, but are not limited to, producing anchor patterns on surfaces prior to coating, removing old surface coatings and rust, surface finishing, deburring parts, metal removal, peening and stress relieving of parts, and providing surfaces with decorative "matte" finishes. Different operations will call for different abrasive materials varying in abrasiveness and particle size. Typical abrasives include aluminum oxide, sand, steel grit, garnet which are cutting abrasives, and shot, glass beads and nut shells which are non-cutting abrasives.

Conventional abrasive blasting systems are two pilot line systems having an "on-off" function only. That is, the operator has an "on-off" remote control handle which he grips to initiate blasting and which he releases to terminate blasting. The quantity of abrasive media which flows through the system is fixed and each time blasting is initiated or terminated the abrasive media holding tank must be pressurized or depressurized. Air blasting an abraded surface requires altogether separate air blasting equipment.

The present invention overcomes the many limitations of conventional blasting systems by providing an abrasive blast system which, in addition to having the usual "on-off" function, permits the operator to modulate or adjust the flow of abrasive media in accordance with the requirements of the blasting operation. The concept of the invention also permits the operator to air blast with the same equipment and to separately and remotely control pressurization and depressurization of the abrasive media holding tank. The highly versatile system of the present invention specifically contemplates the use of two unique cooperating control valves which have interchangeable and modular parts so that they can be adapted to varied system specifications.

SUMMARY OF THE INVENTION

The present invention is an abrasive blast system which because of a unique pneumatic valve system permits the operator to modulate the flow of the abrasive blasting media. The system is comprised of an abrasive media holding tank having an abrasive media discharge line. Means are provided for pressurizing and depressurizing the holding tank, including a pressurized air supply, a remotely controllable inlet valve means, and a remotely controllable outlet valve means. A remotely controllable abrasive flow control valve is connected to the holding tank's abrasive media discharge line. This abrasive flow control valve has a modulation function which permits the flow of the abrasive media from the abrasive media holding tank to be modulated in accordance with the requirements of the particular blasting operation. An abrasive blast directing means extends from the outlet of the abrasive flow control valve. The system further includes a remote control valve disposed to be hand operated by the operator of the abrasive blast system. The remote control valve is capable of actuating both the system's air inlet and air outlet valve means for remotely pressurizing or depressurizing the abrasive media holding tank, and the system's abrasive flow control valve for regulating the flow of abrasive media out of the abrasive media holding tank.

The abrasive flow control valve of the present invention is comprised of a housing having a first and second chamber. The first chamber of the housing has at least one abrasive media inlet port and at least one abrasive media outlet port; the second chamber of the housing is in pneumatic communication with a remotely controllable air supply. Means are provided for introducing air under pressure into the first chamber such that an air flow is created which will propel the abrasive media flowing in through the abrasive media inlet port out through the abrasive media outlet port. A reciprocable plunger assembly is disposed for regulating the flow of abrasive media through the abrasive media inlet port and means are provided for actuating this plunger assembly with respect to the abrasive media inlet port when the second chamber of the valve housing is pressurized by the remotely controllable air supply. Means are also provided for modulating the open position of the plunger assembly for selectively adjusting the flow of the abrasive media flowing through the flow control valve.

The remote control valve of the present invention is comprised of at least two control elements: the first of the two control elements has an air passage input means, an air passage output means, an air passage exhaust means, and a first control valve for selectively connecting the air passage output means to either of the air input or exhaust passage means. A second control element has a main air passage means therethrough in pneumatic communication with both the air passage output means of the first control element and an output pilot line which when pressurized pneumatically actuates the abrasive blast system to a blast condition. The second control element also has an auxiliary air passage means, an air passage exhaust means, and a second control valve adapted for selectively connecting the auxiliary air passage means with either of the main air passage means or the air passage exhaust means. Means are provided for sealingly closing the auxiliary air passage means for capturing pressurized air therein whereby a variably constant air pressure can be maintained in the auxiliary air passage means for actuating the abrasive flow modulation function.

OBJECTS OF THE INVENTION

It is therefore an object of the present invention to provide an abrasive blast system wherein the flow rate of the abrasive media can be modulated in accordance with the requirements of the blasting operation.

It is another object of the present invention to provide an abrasive blast system which can be readily switched from an abrasive blast function to an air blast function, and vice versa.

It is a further object of the present invention to provide an abrasive blast system wherein the operation of the system can be entirely remotely controlled by the operator who is holding the blast nozzle.

It is still another object of the present invention to provide an abrasive blast system with great versatility using a minimum amount of equipment.

It is still a further object of the present invention to provide an abrasive flow control valve capable of regulating the rate of flow of abrasive media from the abrasive blast system's holding tank.

It is yet another object of the present invention to provide an abrasive flow control valve which can act to stop the flow of abrasive media while allowing a continuous high velocity air flow through the valve for air blasting.

It is yet a further object of the present invention to provide an abrasive media flow control valve which can be adapted to either a pneumatically actuated modulation function or a mechanically actuated modulation function.

It is another object of the present invention to provide an abrasive flow control valve which can be assembled with relative ease with interchangeable parts.

It is a further object of the present invention to provide a remote control valve capable of activating more than two pilot lines for remotely controlling the inlet and outlet valves and the abrasive media flow control valve of the abrasive blast system of the present invention.

It is still another object of the present invention to provide a remote control valve which by the addition or deletion of modular portions can operate a two, three, or four pilot line abrasive blast system.

Yet other objects of the present invention will become apparent from the following specification and claims.

DESCRIPTION OF THE PREFERRED EMBODIMENT

The present invention is a highly versatile abrasive blast system which permits the operator of the system to modulate the flow of abrasive media, and which additionally permits him to switch the system from the abrasive blast function to an air blast function. The system contemplates the use and cooperation of two unique valves each of which has a broad range of capabilities. These two unique valves will be described in more detail below.

THE SYSTEM

Figure 2:
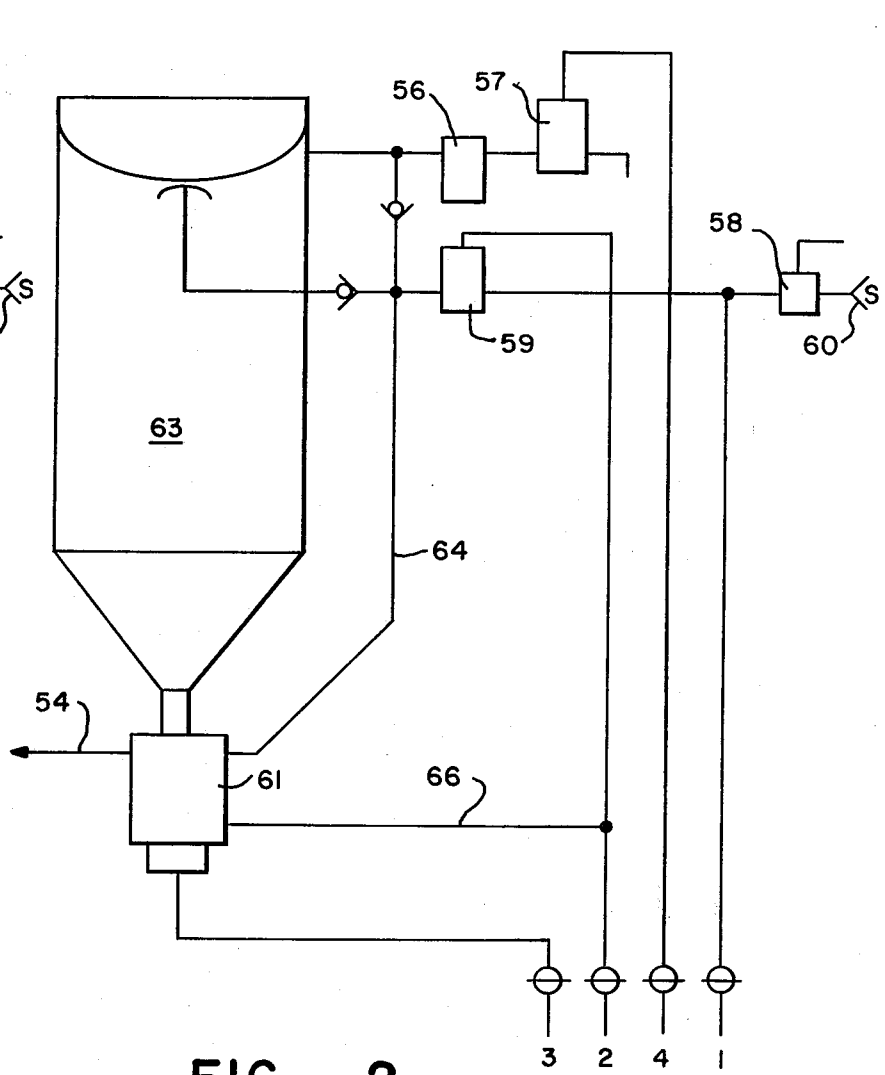
FIG. 2 is a schematic drawing of a four pilot line abrasive blast system, showing the abrasive blast system of FIG. 1 with an additional pilot line to permit separate control of the system's exhaust valve.
Figure 1:
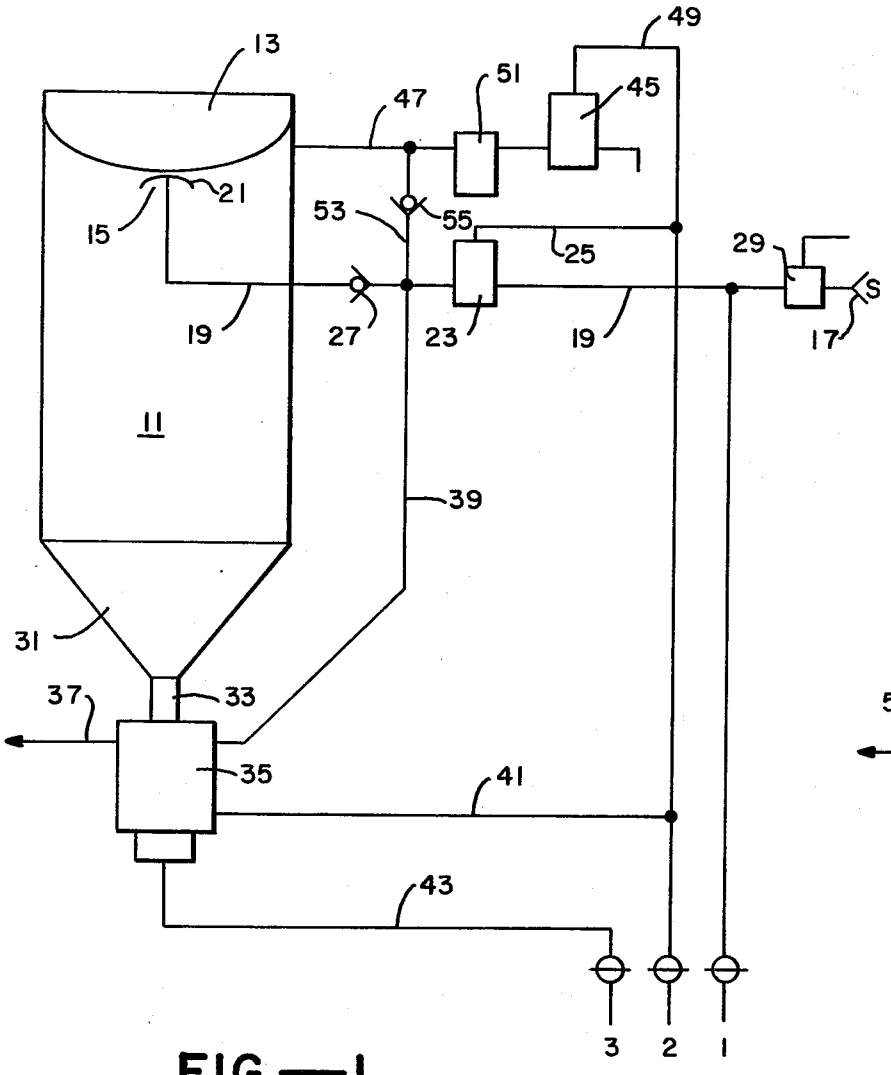
FIG. 1 of the drawings is a schematic diagram of a three pilot line abrasive blast system in accordance with the present invention.

Referring now to the drawings, FIGS. 1 and 2 show a three and four pilot line version of the present invention. While reference will be made to these drawings in describing the system, it is understood that the concept of the present invention is not to be limited to the three and four pilot line arrangements shown, but may also include a two pilot line system and even a five or more pilot line system should the need for additional pilot lines arise.

Three Pilot Line System

Referring to FIG. 1, the three pilot line abrasive blast system shown therein is comprised of abrasive media holding tank 11 which is adapted to receive abrasive media from a superadjacent hopper 13 by way of pop-up valve 15. The pop-up valve is a conventional type which opens by gravity when the tank is depressurized and closes when the tank is pressurized. Means for pressurizing tank 11 include a pressurized air supply 17 which is pneumatically connected to the tank 11 through air supply line 19. As shown, the air supply line extends inside the tank for direct connection with the pop-up valve which has an air inlet stem (not shown) open to the tank. When the system is activated pressurized air feeds to the tank through the pop-up valve stem while the pop-up valve plunger 21 independently seals the tank from the hopper.

Activation of the system through air supply line 19 is controlled by normally closed inlet valve 23 which can be remotely actuated through pilot line 25. Preferably, a check valve 27 is placed in the air supply line between pop-up valve 15 and inlet valve 23 to prevent a backflow of air and abrasive material from fouling the inlet valve.

To permit depressurization of holding tank 11, normally open exhaust valve 45 is pneumatically connected to the holding tank through exhaust line 47. The exhaust valve coacts with inlet valve 23 such that when the inlet valve is closed the exhaust valve is open, and vice versa. Common control of the inlet and exhaust valves is achieved by pneumatic connection of their pilot lines 25, 49. Since during depressurization of the holding tank some abrasive media is carried down exhaust line 47, abrasive trap 51 is placed on line with the exhaust valve between the exhaust valve and the holding tank.

It is noted that an air extension line 53 pneumatically connects the exhaust line 47 to air supply line 19. This extension line allows holding tank 11 to be pressurized through the exhaust line as well as through pop-up valve 15 thereby reducing the time required to pressurize the tank. A check valve 55 is placed in the extension line to prevent a backflow of air from the exhaust line. The presence of this check valve together with the check valve 27 in the air supply line prevents the holding tank from exhausting through air inlet line 39 when the tank is being depressurized. Without the two above-mentioned check valves, there would be, after blasting is terminated, a residual flow of abrasive from the system while the tank depressurizes.

Attached to the abrasive media discharge line 33 of holding tank 11 is the system's unique abrasive flow control valve 35. The abrasive flow control valve is also pneumatically connected to air supply line 19 by means of air line 39 such that whatever line pressure is seen at the tank is also seen at the flow control valve. When inlet valve 23 is opened air is caused to flow through abrasive flow control valve 35 to propel the abrasive media being allowed to flow into the valve from the holding tank 11 out through abrasive blast hose 37, and from there out the end of the abrasive blast nozzle (not shown) secured to the free end of the abrasive blast hose. The abrasive flow control valve is normally closed and is pneumatically actuated to an open or "on" position through pilot line 41. It should be noted that, because the pilot lines 25, 49, 41 of the inlet, exhaust, and flow control valves are pneumatically joined, the actuation of the flow control valve 35 occurs simultaneously with the actuation of the inlet and exhaust valves 23, 45.

In addition to its above-described on-off function, the abrasive flow control valve 35 of the present invention also has a pneumatically actuated modulation function separately and remotely controllable through pilot line 43. Through this additional pilot line, an operator after initiating blasting can separately modulate or adjust the flow of abrasive media. It is understood that the abrasive flow can be modulated from a maximum available flow to no flow at all. In the latter event, the abrasive flow control valve simply acts as a pneumatic connection between air line 39 and abrasive blast hose 37 whereby the overall system is acting in an air blasting mode.

The pilot lines for controlling the inlet valve 23, exhaust valve 45, and abrasive flow control valve 35 extend to a remote control valve (not shown) which is disposed to be hand operated by the operator of the abrasive blast system when blasting with the abrasive blast nozzle. There are actually three pneumatically isolated main pilot lines which extend to the remote control valve and which are denoted 1, 2, and 3 in FIG. 1. The first pilot line (1) brings pilot pressure from pressurized air supply 17 to the remote control valve when the system is activated through manual valve 29. The second pilot line (2), when pressurized by the remote control valve, actuates the inlet valve 23 (to an open condition) and exhaust valve 45 (to a closed condition) causing abrasive holding tank 11 to be pressurized and further causing air to flow through air line 39. The second pilot line also actuates the abrasive flow control valve through pilot line 41 to permit abrasive media to be discharged from the holding tank so that it can be propelled through abrasive blast hose 37 by the flow of air from air line 39. The third pilot line (3) activates the modulation function of the abrasive flow control valve for adjusting the flow of the abrasive media from the holding tank. It has been stated that by adjusting the flow to zero actuation of the system's inlet, exhaust, and flow control valves will result in air blasting only.

FOUR PILOT LINE SYSTEM

FIG. 2 of the drawings illustrates how an additional pilot line can be used to separately control exhaust valve 57. For convenience, the pilot lines in FIG. 2 are denoted 1,4,2,3, showing the addition of pilot line (4). The first pilot line (1), like the first pilot line of the three pilot line system of FIG. 1, brings pilot pressure to the remote control valve from the pressurized air supply 59. The new fourth pilot line (4) directly actuates exhaust valve 57 while the second pilot line (2) actuates both inlet valve 59 and the abrasive flow control valve 61. The modulation function of the abrasive flow control valve is provided by the third pilot line (3). The four pilot line system is in all respects the same as the three line system of FIG. 1, except that the exhaust valve can be actuated independently from the inlet and abrasive flow control valves thus enabling the operator of the four line system to terminate blasting without having to depressurize abrasive holding tank 63; the holding tank is only depressurized upon separate actuation of exhaust valve 57 through the fourth pilot line. Thus, using the four pilot line abrasive blast system, blasting can be initiated and terminated at will without having to wait for the holding tank to be repeatedly pressurized. Only when the blasting operation is completed or the holding tank runs out of abrasive media would the system's exhaust valve 57 be opened.

Again, it is contemplated that a two pilot line blast system can be utilized wherein the modulation function described above as being actuated by a separate pilot line would instead have a mechanical actuation means at the abrasive flow control valve itself. A description of the flow control valve follows.

ABRASIVE FLOW CONTROL VALVE

Figure 3:
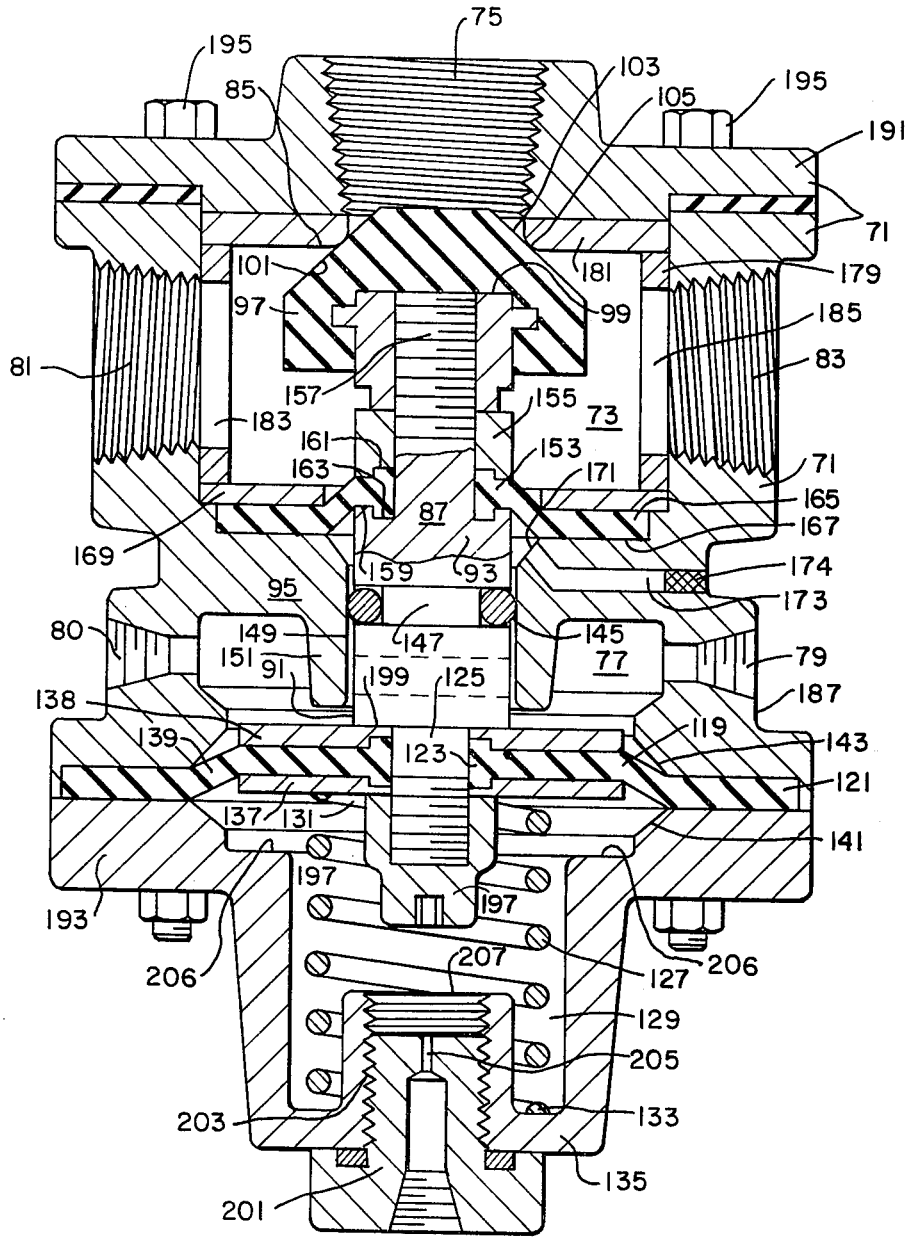
FIG. 3 is a cross-sectional view of the abrasive flow control valve of the present invention showing the pneumatically controlled modulation function.

Referring to FIG. 3 of the drawings, the abrasive flow control valve of the present invention is comprised of a housing 71 in which there is formed a first chamber 73 adapted to receive abrasive media and a second chamber which is in pneumatic communication with a controllable pilot air supply. The first chamber 73 has an abrasive media inlet port 75 and an abrasive media outlet port 81 which provide, respectfully, communication with the system's abrasive media holding tank 11, 63, and an externally attached abrasive blast hose 37, 54. Means are provided for introducing air under pressure into the first chamber of the abrasive flow control valve such that any abrasive media flowing in through inlet port 75 is propelled in a fluidized stream out through outlet port 81. Preferably, this means for introducing air into the first chamber is comprised of air inlet port 83 connectable to an external air line 39, 64 which in turn is in pneumatic communication with the pressurized air supply of the abrasive blast system. As shown in FIG. 3, the preferred arrangement of the above described three ports 75, 81, 83 in first chamber 73 are such that the abrasive media inlet port is located in the chamber's top end wall 85 with the air inlet port 83 and the abrasive media outlet port 81 being located substantially opposed to one another in the chamber's side walls so as to provide a substantially straight air flow path across the chamber.

The second chamber 77 of the abrasive flow control valve has a pilot port 79 adapted to connect with an external pilot line. Preferably, the second chamber is also provided with an emergency exhaust port 80 whereby in the event of a system malfunction the second chamber could be manually depressurized.

Plunger assembly 87 is disposed for regulating the flow of abrasive media through abrasive media inlet port 75 and into chamber 73. The plunger assembly which can be reciprocably moved with respect to the abrasive media inlet port is actuated by pressurizing the second chamber 77. As shown, the plunger assembly extends between the valve's first and second chambers and is comprised of a central shaft portion 93 passing through an opening in the housing wall 95 which separates the two chambers. Stopper means 97 secured to the end of the plunger shaft portion is disposed in chamber 73 and is shaped to seal the abrasive media inlet port when forced thereagainst by the plunger assembly. The stopper means shown in FIG. 3 is of a design to be used with non-cutting abrasive media such as shot; it is preferably fabricated from a molded elastomeric material vulcanized to an internally threaded steel insert 99 which can be screwed onto a corresponding threaded portion 157 at the end of the plunger shaft. As shown, the stopper means has a cork-like configuration whose angled surface 101, 103 can be forced into the abrasive media inlet port 75 for sealingly engaging the inner edge 105 of the port.

Figure 6:
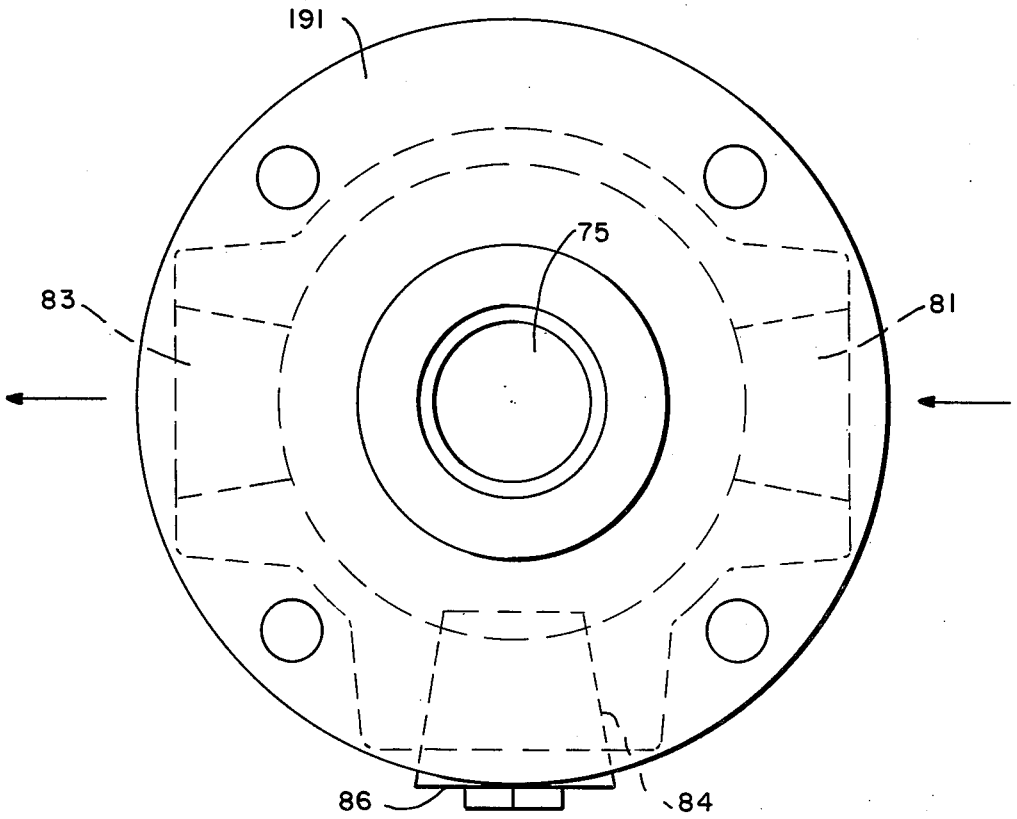
FIG. 6 is a top end view of the abrasive flow control valve shown in FIGS. 3–5.

FIG. 6 shows an alternative stopper means design which can be used for more highly abrasive media such as steel grit or sand. To withstand the wear of such highly abrasive materials, this stopper means is preferably a machined stainless steel part having a disc shaped body 107 with a raised annular portion 109 of a diameter to meet with a corresponding annular sealing material 111 disposed around opening 113 of abrasive inlet port 150. As can readily be seen, the abrasive media inlet port is sealed closed when this embodiment of the stopper means is forced against opening 113 by the plunger assembly. An internally threaded portion 117 of the stopper means of FIG. 6 permits it to be secured to the threaded end of the plunger shaft in the same manner as molded stopper means 97. Thus, the stopper means of one design can be readily exchanged for the stopper means of the other design depending on the nature of the abrasive media to be used.

To actuate plunger assembly 87 for opening and closing abrasive media inlet port 75, a deflectable wall, such as pressure diaphragm 119, is provided which forms substantially one wall of the valve's second chamber 77. With the outer portion 121 of the pressure diaphragm secured to the housing and the moveable inner portion 123 secured to the shaft of the plunger assembly proximate its second end 125, any movement or deflection of the diaphragm will cause axial movement of the plunger assembly with respect to the valve housing, and in turn, cause the stopper means 97, 107 to move toward or away from the abrasive media inlet port 75, 115. Reciprocal movement of the plunger assembly acts to open and close the valve to initiate and terminate blasting.

Means are provided for biasing the plunger assembly 87 to close the abrasive media inlet port 75, 115, while the second chamber remains unpressurized, thus placing the flow control valve of the present invention in a normally "off" condition. The biasing means must be chosen such that the biasing forces will be overcome by available pilot pressure whereby pressurization of second chamber 77 will move the plunger assembly to open the abrasive media inlet port. In the specific embodiments of the invention shown in FIGS. 3 and 4, the biasing means is comprised of biasing spring 127 disposed in a state of partial compression in a third chamber 129 formed in the valve housing directly behind pressure diaphragm 119. As shown, the top end 131 of the spring engages the pressure diaphragm and the bottom end 133 of the spring engages the inner surface of the bottom housing wall 135 so as to exert a sufficient force against the pressure diaphragm to hold the plunger assembly closed against the weight of the abrasive media in the holding tank and against air pressure forces external to the second chamber 77.

Pressure diaphragm 119 which is fabricated from a flexible elastomeric material is reinforced by metal plates 137 and 138 to give the pressure diaphragm suitable rigidity. The reinforcement plates are of a diameter to leave a relatively small unreinforced annular portion 139 of the diaphragm which flexes when the diaphragm is deflected. Conical surfaces 141 and 143 are provided immediately adjacent the flexing portion of the diaphragm to provide a suitable seating surface for the stressed part of the diaphragm.

Since pneumatic and abrasive integrity must be maintained between the first chamber 73 and the second chamber 77 of the valve, means are provided for pneumatically sealing the plunger assembly to the housing wall through which the plunger shaft passes. Referring to the embodiment shown in FIG. 3, this sealing means is preferably comprised of O-ring 145 fitted in an O-ring groove 147 machined substantially midway between the two ends of plunger shaft 87. The central bore 149 in housing wall 95 through which the plunger assembly shaft passes has a diameter which permits the plunger assembly shaft with O-ring 145 to be forceably inserted therein. To accomodate the full reciprocal movement of the plunger assembly, the housing wall surrounding the plunger shaft is extended in the form of neck 151 which protrudes into the valve's second chamber 77.

To further seal the plunger assembly to the housing, a sealing diaphragm 153 is secured to the plunger shaft 87 proximate the first end thereof. To seal the diaphragm to the shaft, a collar is provided which slidably fits over the shaft's threaded end 157. This collar is caused to firmly seat against the diaphragm by tightly screwing the stopper means 97 thereagainst. The inner portion of the sealing diaphragm surrounding the plunger shaft is thereby wedged between the collar and the opposed shoulder surface 159 of the plunger shaft with the pliant diaphragm material being pressed into grooves 161 and 163 preferably formed on the opposing collar and shoulder surfaces. The outer diameter 165 of the sealing diaphragm 153 is secured to the housing substantially adjacent to the first chamber 73. This is preferably achieved by a cutout portion 167 in the housing matched closely in size to the diaphragm's outer diameter. When the diaphragm is pressed into this cutout portion, it can be held in place by bottom liner plate 169.

The upper edge of bore 149 is preferably chamfered to form a conically shaped seating surface 171 for the flexed portions of the sealing diaphragm 153. Air relief passage 173, preferably having a filter element 174 therein, is disposed to relieve air trapped in the space formed between conical seat 171 and the sealing diaphragm.

Figure 4:
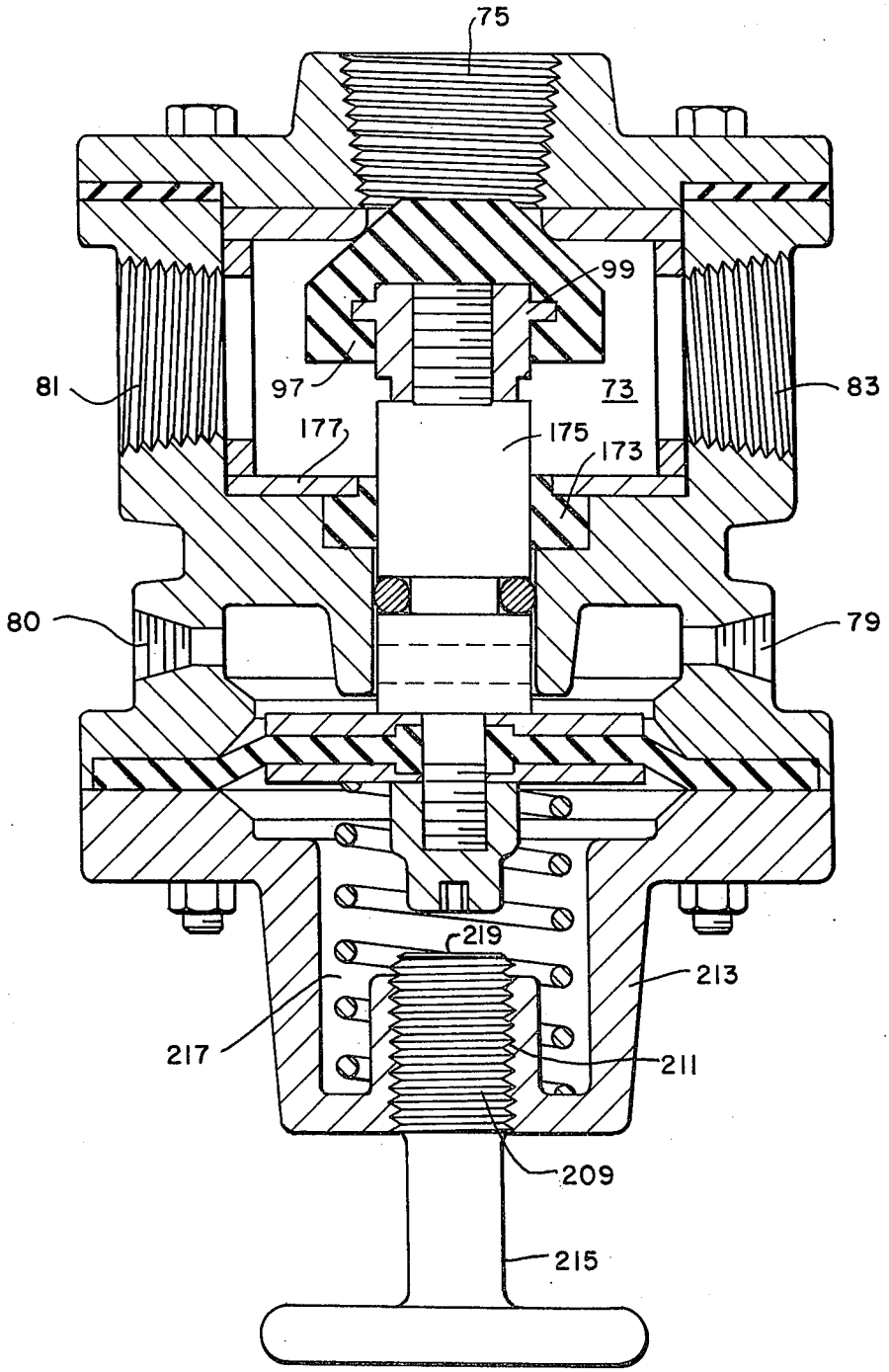
FIG. 4 is a cross-sectional view of the abrasive flow control valve of the present invention showing the mechanically actuated modulation function.
Figure 5:
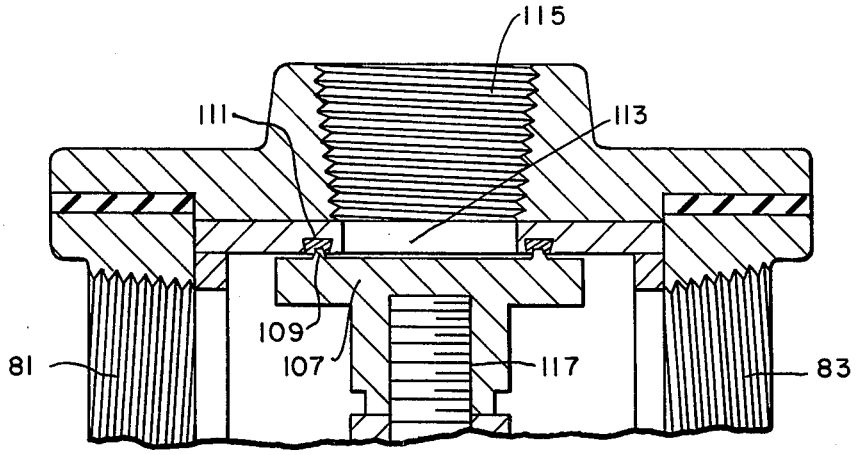
FIG. 5 is a partial cross-sectional view of the abrasive flow control valve of FIGS. 3 and 4 showing an alternative embodiment to the stopper means at the end of the plunger assembly.

It is understood that sealing diaphragm 153 is just one possible means of maintaining the pneumatic integrity between chamber 73 and 77. Another possible sealing means is shown in FIG. 4 wherein there is provided a wiper rod seal 173 disposed to tightly surround plunger assembly shaft 175. Bottom abrasive liner plate 177 holds the wiper rod seal in position.

In addition to the bottom abrasive resistant liner plate 169 (177 in FIG. 4), the first chamber 73 of the abrasive flow control valve has abrasive resistant liners to protect the chamber's side walls and top end wall 85 from being worn by the abrasive media flowing through the chamber. Preferably, there are two additional liner insert elements: an abrasive resistant wall liner 179 removeably insertable into the first chamber for protecting the chamber's side walls, and particularly the side wall area proximate the abrasive media outlet port 81; and a top liner plate 181 for protecting the top end wall of the chamber. The wall liner 179 necessarily has openings 183 and 185 which align with the first chamber's abrasive media outlet port 81 and air inlet port 83. Since most wear will occur at the outlet port, by locating the abrasive media outlet port and air inlet port 180° apart from one another openings 183 and 185 can be interchanged with respect to these two opposed ports whereby when the liner wears down at the first opening to be aligned with the output port, the other opening can be rotated in its place. Preferably, the first chamber 73 and liner 179 have a cylindrical shape with the liner having four openings spaced 90° apart to provide four available openings for the outlet port.

It is noted that the preferred embodiment of the abrasive media flow control valve of the present invention would include yet a third port 84 (see FIG. 6) in the first chamber 73 located 90° from both the abrasive media outlet port 81 and the air inlet port 83. This port would align with one of the four equally spaced openings in the cylindrical abrasive resistant liner 179. The purposes of such a third port which is normally sealed by plug 86 are several: First, it would allow a separate access to the first chamber of the valve such that this chamber could be periodically cleaned and such that wear at the abrasive media outlet port could be periodically determined. It would also allow access for the purpose of tightening the stopper means 97 on to the plunger assembly shaft 87. Finally, the plug 86 would position abrasive liner 179 and prevent it from rotating.

The flow control valve is designed such that the plunger assembly, diaphragms, and liners can be easily assembled within the valve's housing. The housing is actually comprised of a housing body 187 and a top and bottom housing cap 191 and 193 capable of being secured to the housing body by bolts 195. Referring to the embodiment in FIG. 3, with both top and bottom housing caps off, the plunger shaft with its O-ring 145 is first inserted through the center bore extending between the first and second chambers. With the shaft in place both the sealing diaphragm 153 and the pressure diaphragm 123 can be forced onto their respective ends of the shaft; collar 155 is then placed over the threaded end of the shaft 157 with its retaining groove 161 oriented as shown, and then the stopper means 97 is screwed onto the end of the shaft forcing the collar tightly against the sealing diaphragm. At the other end of the plunger shaft, allen head nut 197 is screwed onto the threaded second end 125 of the plunger shaft firmly against the pressure diaphragm until the pressure diaphragm is pressed securely between the allen head nut and shoulder 199 of the plunger assembly. Once the plunger assembly, diaphragms, and liners are in place, the top and bottom housing caps can be bolted in place. Final tightening of the stopper means and allen head nut onto the plunger shaft can be achieved, respectively, through the third view port 84 in the first chamber 73, and the central opening 203 in the bottom housing cap.

MODULATION FUNCTION

The modulation function of the abrasive flow control valve is shown in two different embodiments in FIGS. 3 and 4 of the drawings. FIG. 3 shows a pneumatic modulation means wherein the third chamber 129 of the valve, which is disposed directly behind pressure diaphragm 123 from second chamber 77, is a variable pressure chamber which is capable of being pressurized to any selected modulating pressure from approximately atmospheric pressure to approximately the pressure available to the second chamber. The modulation pressure is introduced into the third chamber through threaded plug 201 threadedly inserted into a correspondingly threaded opening 203 in the bottom portion of the bottom housing cap 193. Plug 201 has a small, needle air passageway 205 extending therethrough which tapers into a large air passageway which in turn is capable of being connected to a remote modulating air supply. Referring to FIG. 1 of the drawings showing the three pilot line abrasive blast system, it would be the third pilot line which would be connected to insert plug 201 for supplying modulation pressure to the third chamber.

With respect to the operation of the pneumatic modulation function, it is first noted that the annular shoulder surface 206 formed in the upper portion of the third chamber 129 provides a seat for the pressure diaphragm for limiting the maximum movement of the plunger assembly when the second chamber is pressurized. Secondly, it is noted that the biasing spring disposed in the third chamber behind the pressure diaphragm is further compressed by the deflection of the pressure diaphragm, and that the force exerted by the spring on the pressure diaphragm is proportional to the distance to which the spring is compressed. The biasing spring must be chosen such that the pilot pressure available to the second chamber will overcome the spring's restoring force so as to compress the spring a given distance. Now, if the third chamber 129 is gradually pressurized, the pressure diaphragm 123 will experience a force opposing its outward deflection equal to the area of the pressure diaphragm times the modulation pressure. This opposing modulation force will combine with the opposing force of the compressed biasing spring to determine the position of the plunger assembly. This occurs essentially as follows: When the second chamber 77 is pressurized the force exerted on the second chamber side of the pressure diaphragm is equal to the second chamber pilot pressure times the area of the pressure diaphragm. If the opposing force of the modulation pressure and biasing spring is less than the force generated by the second chamber pilot pressure, then the pressure diaphragm will not unseat from its seating shoulder 206. As the modulation pressure is selectively increased, the opposing force of the modulation pressure and spring will eventually equal and exceed the second chamber pilot pressure force. When this happens, that is, when the forces on the third chamber side of the diaphragm exceed the forces on the second chamber side, the pressure diaphragm, and hence the plunger assembly, will incrementally move until the restoring force of the bias spring incrementally decreases to a point where the forces on both sides of the diaphragm are equalized. Any given modulation great enough to unseat the pressure diaphragm will thus coact with the linearily variable restoring force of the compressed biasing spring to determine the open position of the plunger assembly. By thusly controlling the open position of the plunger assembly, the modulation pressure controls or regulates the rate at which the abrasive media flows into the first chamber 73 and hence out through the abrasive media outlet port 81.

The mechanical alternative of the modulation function, which is shown in FIG. 4, is identical to the pneumatically modulated valve of FIG. 3, except that the insert plug 201 of FIG. 3 is replaced by a solid threaded plug 209 which is threaded to fit the correspondingly threaded opening 211 formed in the housing cap 213. The solid threaded plug 209 has a handle 215 projecting therefrom which can be turned by an operator to control how much the plug projects into third chamber 217 of the valve. It is seen that the end surface 219 of solid plug 209 forms a moveable seat 219 disposed to engage the allen head nut 221 secured to the second end of the plunger assembly. The moveable seat of the solid plug in this mechanical modulation version of the valve thus determines the maximum deflection of the plunger assembly when second chamber 77 is pressurized.

It is particularly noted that, in both the pneumatic and mechanical versions of the valve's modulation function, the modulation can be increased to prevent the plunger assembly from moving at all thereby keeping abrasive media inlet port closed when the second chamber 77 is pressurized. With this "maximum" modulation, the flow control valve simply acts as a conduit between the air inlet port 83 and the opposed abrasive media outlet port 81 of the first chamber whereby the abrasive blast system operates in an air blasting mode.

REMOTE CONTROL VALVE

The remote control valve of the abrasive blast system of the present invention is used by the operator to initiate and terminate blasting. It also supplies the required modulation pressure to the pneumatically modulated abrasive flow control valve shown in FIG. 3 in the event that version of the flow control valve is used. The present remote control valve is of the modular design and is uniquely capable of being adapted to the demands of the abrasive blast system and the number of pilot lines to be used. As in the remote control valves of conventional blast systems, the remote control valve of the present invention is secured to the end of the abrasive blast hose such that it can be easily hand operated.

Figures 7, 8:
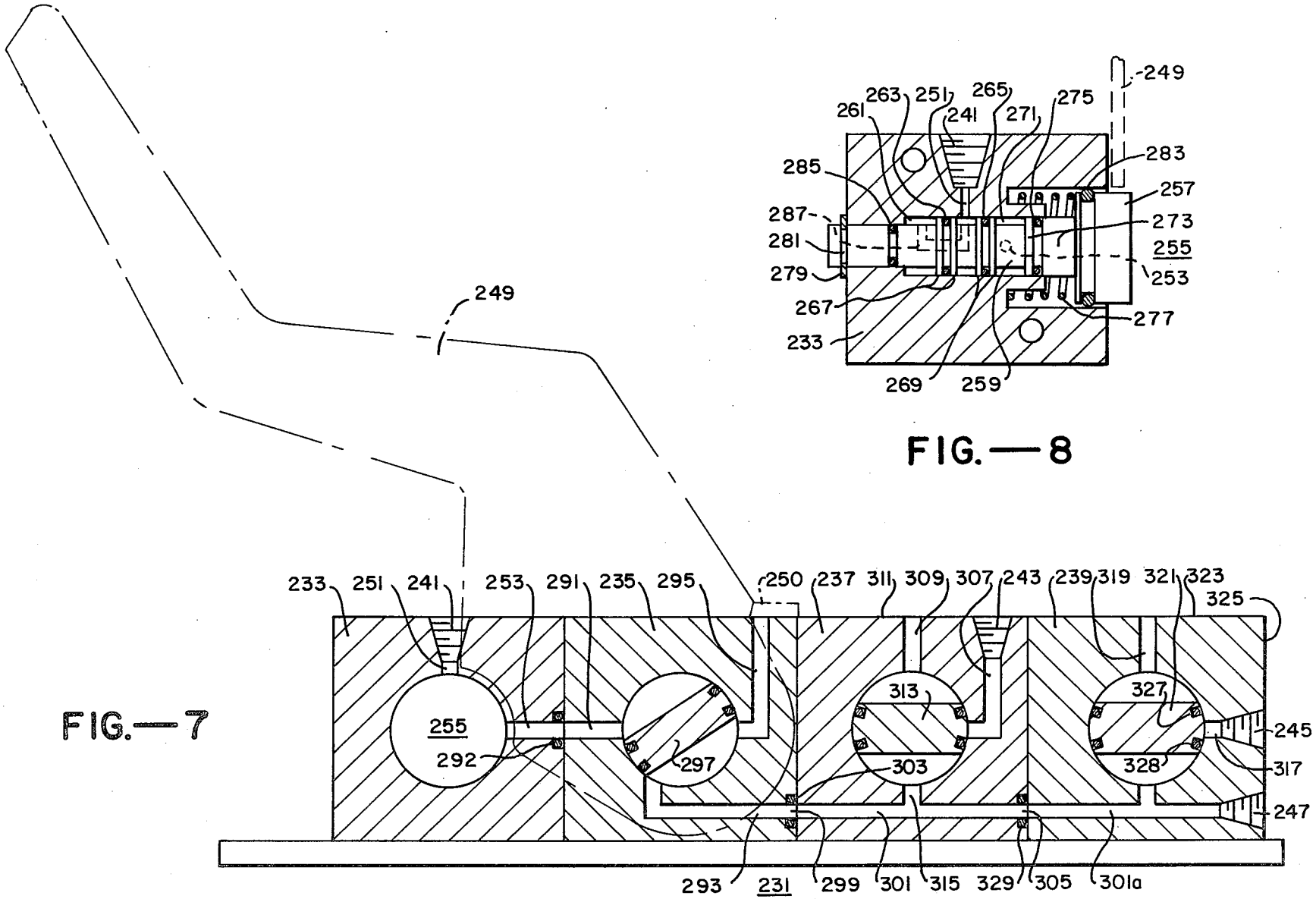
FIG. 7 is a cross-sectional view of the remote control valve of the present invention showing the blasting control handle in an "off" position.
FIG. 8 is a cross-sectional view of the detent element of the remote control valve of FIG. 7.
Figure 9:
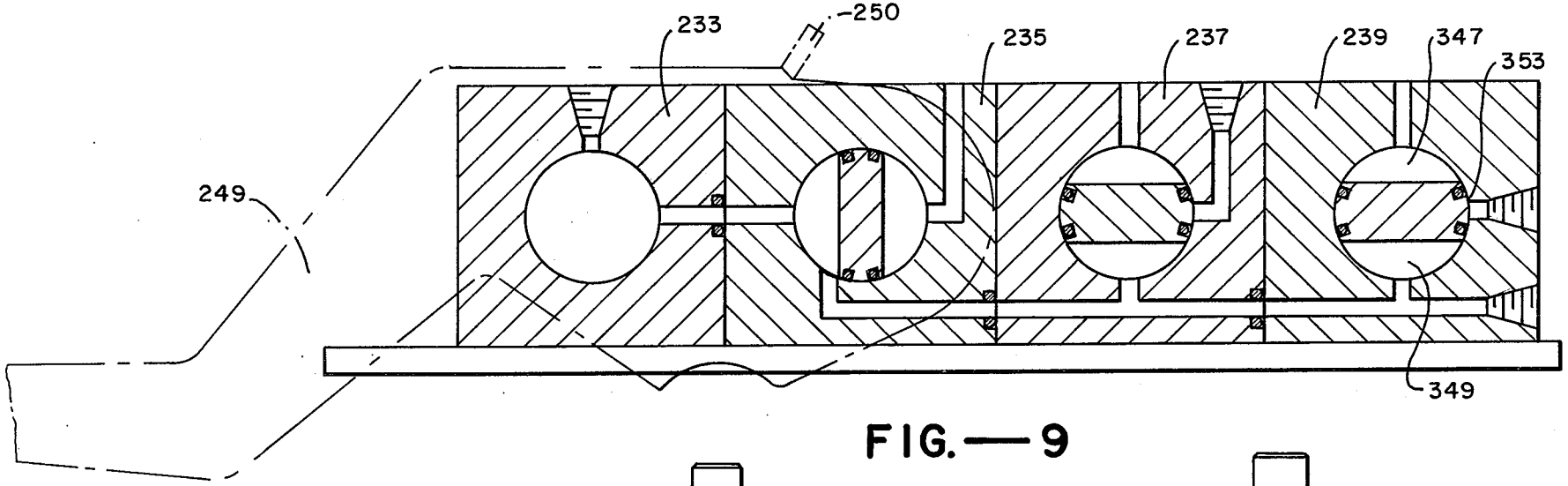
FIG. 9 is a cross-sectional view of the remote control valve of FIG. 7 showing the blasting control handle in the blasting or "on" position.

The construction of the remote control valve of the present invention is shown in FIGS. 8–11 of the drawings. Referring to FIGS. 7 and 9, valve 231 has a multiple of modular elements 233, 235, 237, 239, capable of independently controlling the pilot pressure to the different pilot lines of the abrasive blast system. It is noted that the remote control valve shown in FIGS. 7 and 9 is compatable with a four pilot line system as shown in FIG. 2, and has four pilot line connection ports 241, 243, 245, 247. The four pilot lines would be connected to the remote control valve as follows: pilot line 1, the pilot air supply, would be connected to pilot line connection port 241; the second pilot line (pilot line 2) for controlling the system's exhaust valve 45 would be connected to pilot line connection port 243; pilot line 3 which simultaneously actuates inlet valve 23 and abrasive flow control valve 35 would be connected to pilot line connection port 247; and pilot line 4, the modulation pilot line for the abrasive flow control valve, would be connected to pilot line connection port 245.

As shown, the modular elements of the remote control valve each have a generally cubical shape and are secured one to the other in an end to end alignment such that one control element is in pneumatic communication with its next adjacent control element. The modular elements can be considered separately according to their function. Elements 233 and 235 combine functionally into a first control element actuated by detent element 255 and handle 249; this first control element acts to releasably supply pilot pressure from the pilot pressure supply line connected to port 241 to the other pilot lines of the system. Element 239, shown at the end of the four elements, 233, 235, 237, 239, provides a second control element which can be separately actuated to control the pressure in the auxiliary modulation line for modulating the abrasive flow control valve. Element 237 provides a third control element for selectively actuating the system's exhaust valve.

Turning first to modular element 233 of the first control element, this element, which provides a detent function, has an air input passageway 251 in connection with pilot line connection port 241, and an outlet passageway 253. Between the air inlet and outlet passageways is a detent element 255 which can be actuated to bring the air input and output passageways 251 and 253 into pneumatic communication and, as will be seen, to permit actuation of the remote control valve's main control handle 249. The specific embodiment of the detent element is shown in FIG. 8. The detent element is a spool type valve comprised of a detent button 257 secured to an axially movable spool member 259 disposed in cavity 261. Cavity 261 is formed substantially in the center of the modular element 233. O-rings 263 and 265 placed between spool runner pairs 267 and 269, together with O-rings 275, 283, and 285 placed, respectively, on the end of the spool member and on the detent button, support and pneumatically seal the spool member within cavity 261. To the right of O-ring 265, there is an annular air space 271 formed between the rightmost runner of runner pair 269 and the enlarged diameter portion 273 of the spool member. This annular air space is sealed by O-rings 265 and 275. With the spool member of the detent element in the position shown in FIG. 8, it is seen that the annular air space 271 is in pneumatic communication only with the outlet air passageway 253 of the valve element. By pressing the detent button 257, O-ring 265 moves to the left of air inlet passageway 251 such that the annular air space 271 spans both air inlet passageway 251 and air outlet passageway 253, thereby placing the one into pneumatic communication with the other. With the detent button so depressed air is permitted to flow into the next adjacent modular element 235; when the detent button is released, it is returned to its original "off" position by bias spring 277 to prevent further air flow through the element. The return of the detent button by spring 277 is limited by snap ring 279 which is placed in a snap ring groove 281 formed near the free end of the detent element's spool member which, as shown, projects outside the body of the modular element 233.

To assist the bias spring 277 in holding the detent button in an "off" position, the air spaces on either side of O-ring 263 are pneumatically connected by air passage 287. Thus, with the imprint pilot pressure available to the air space to the left of O-ring 263 the spool member acting like a piston tends to be forced to the right.

It is important to note that detent button 257 provides a mechanical stop for handle 249 such that the handle cannot be rotated counter-clockwise into the position shown in FIG. 9 unless the detent button has been pushed in. If the handle is actuated and then released, a spring biasing means (not shown) returns it to the position shown in FIG. 7. To prevent any further clockwise rotation of the handle beyond that shown in FIG. 7 a stop member 250 formed on the handle is disposed to engage the body of the remote control valve when the handle is released.

The second modular element 235 which completes the first control element of the remote control valve has three separate air passage means, 291, 293, 295, leading to a rotatable "closed-center" valve element 297. The three separate air passage means consist of an air inlet passage means 291 pneumatically connected by O-ring seal 292 to the air outlet passageway 253 of modular element 233, an air outlet passage means 293 pneumatically connected to the next adjacent modular element 237, and an air passage exhaust means 295 in communication with the outside atmosphere. Valve element 297, which is actuated by control handle 249, can selectively place the air outlet passage means 293 of this second modular element into pneumatic connection with either the air input passage means 291 or the air passage exhaust means 250. If the air inlet and outlet passage means are pneumatically connected by pressing control handle 249 down as shown in FIG. 9, then the pilot pressure seen at air outlet passageway 253 of first modular element 233 is also seen at the output 299 of the second modular element 235. If by releasing the control handle valve element 297 is rotated to pneumatically connect air passage means 293 to the air passage exhaust means 295 (see FIG. 7), then the pilot pressure at output 299 will be shut off from air inlet passage means 291, and the air outlet passage means will see atmospheric pressure causing the residual pilot pressure in the output line to exhaust through the element's air passage exhaust means. Thus, it is seen that control handle 249 together with detent button 255 and the two modular elements associated therewith control the overall "on-off" function of the remote control valve by determining whether pilot pressure is available to the next adjacent modular elements of the valve. It is understood that no additional modular elements would be required in the case of a two pilot line system whereupon the output 299 of modular element 235 would be connected directly to the pilot line used to actuate the inlet, exhaust, and abrasive flow control valves of the system. Such a two pilot line would contemplate the use of an abrasive flow control valve having the mechanical modulation function as shown in FIG. 4.

The third modular element 237, which is directly to the right of modular element 235 and which controls the exhaust valve 45 of the four pilot line system, consists of a main air passage means 301 pneumatically connected by O-ring seal 303 to the air outlet passage means 293 of the second modular element 235. This main air passage means extends entirely through the cubical element such that any pilot pressure which appears at output 299 of the second modular element 235 also appears at output 305 at the opposite side of the third modular element. Third modular element 237 also consists of an auxiliary air passage means 307 and an air passage exhaust means 309 both of which extend to the same outside top surface 311 of the cubical modular element. These two air passageways internally terminate at a rotatable "closed-center" valve element 313 disposed in the third modular element; the main air passage means is also pneumatically connected to the closed-center valve element by means of branch air passageway 315. As shown, the branch air passageway 315 and the air passage exhaust means 309 preferably meet the circumference of the spool-shaped element 313 at an opposed 180° spacing, and at 90° from the auxiliary air passage means 307. Thus, it can be seen that rotation of the valve element from the closed-center position shown in FIGS. 7 and 9 will pneumatically connect the auxiliary air passage means 307 to the main air passage means 301 or to the air passage exhaust means 309, depending on the direction of rotation.

Unlike the valve element 297 in the second modular element 235 which is a two position "on-off" valve, the valve element 313 of the third modular element 237 is a three position valve. The position shown in the drawings is a closed-center position which, because of the unique double O-ring configuration (discussed in more detail below), seals the auxiliary air passage means to maintain whatever pilot pressure exists in the pilot line connected to port 243. If the valve element is rotated counter-clockwise by approximately 45° (the second of its three positions), the pilot line connected to port 243 will be pressurized by means of main air passage means 301 (this assumes of course that the control handle 249 is in the "on" position shown in FIG. 9). If the valve element is instead rotated clockwise by approximately 45° (the third of its three positions), then the pilot line connected to port 243 will be depressurized by exhausting through air passage exhaust means 317. Referring to the four pilot line abrasive blast system shown in FIG. 2, the exhaust valve 45 is remotely actuated as follows: The valve element 313 of modular element 237 is turned to its counter-clockwise (second) position. This places the exhaust valve actuating pilot line in pneumatic communication with main air passage means 301. Thus, when control handle 249 is rotated to the "on" position, the pilot pressure which appears in the main air passage means also appears in the exhaust valve pilot line thereby closing the system's exhaust valve to allow the abrasive media holding tank 11 to be pressurized. The valve element can then be rotated to its central closed-center position to hold the pilot pressure in the exhaust valve pilot line when control handle 249 is released to exhaust the main air passage means 301. Therefore, at the option of the operator, the abrasive media holding tank 11 can be prevented from depressurizing when blasting is terminated. When it is desired to open the system's exhaust valve 45, the pilot pressure is simply released by turning the valve element 313 to its clockwise third position.

The end modular element 239 of the remote control valve is nearly identical in construction and operation to the above-described third modular element 237. This end modular element has a main air passage means **301*a*, an auxiliary air passage means 317, and an air passage exhaust means 319, all of which communicate to a three-position valve element 321 capable of selectively placing the auxiliary air passage means 317 in pneumatic communication with either of the main air passage means 301*a* or air passage exhaust means 319. The first difference between this end modular element and the third modular element 237 is that the auxiliary air passage means 317, instead of extending at a right angle to the top outside surface 323 of the cubical element, extends directly out to the element's end outside surface 325. The other difference is in the presence of the pilot line connection port 247** at the end of main air passage means 301*a*. Because the two pilot line connection ports 245 and 247 are disposed in the end wall 325 of this end modular element of the remote control valve, the two pilot lines extending therefrom can be conveniently bunched and secured to the abrasive blast hose.

End modular element 239 is the control element of the remote control valve which permits the operator of the four pilot line system to modulate the flow of abrasive media carried in the abrasive blast hose. The operation of its three-position valve element is similar to that of valve element 313 of adjacent modular element 237. In the closed-center position shown in FIGS. 7 and 9, the auxiliary air passage means and the modulation pilot line connected to pilot line connection port 245 are sealed closed by double O-rings 327 and 328. If valve element 321 is rotated 45° counter-clockwise and there is pilot pressure in the main air passage means 301*a* (which is pneumatically connected by O-ring seal 329 to the output 305 of modular element 237), then the maximum available pilot pressure from main passage means 301*a* is impressed on the modulation pilot line the opposite end of which is connected to the bottom plug 201 of the abrasive flow control valve (see FIG. 3). Conversely, if valve element 321 is rotated 45° clockwise, the modulation pilot line will be exhausted to atmosphere through air passage exhaust means 319.

Because of the high impedance of the small needle air passageway 205 which extends through the flow control valve plug 201, pressurization of depressurization of the modulation pilot line will only slowly effect the pressure in the flow control valve's third chamber 129. Thus, when valve element 321 is turned counter-clockwise, the pressure in third chamber 129 gradually increases; when the valve element is turned clockwise to the exhaust position it gradually decreases. This means that the flow of abrasive media, as determined by the open position of the flow control valve's plunger assembly 87, which in turn is determined by the pressure in the flow control valve's third chamber, gradually decreases when valve element 321 is turned to its counter-clockwise position, and gradually increases when the valve element is turned to its clockwise position. When the flow has increased or decreased to the desired level, it is fixed at that level by simply returning valve element 321 to its closed-center position.

Figure 11:
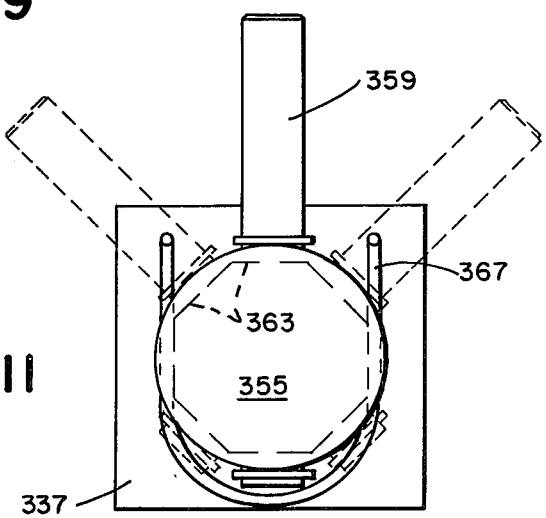
FIG. 11 is a front elevational view of the control valve element of FIG. 10 showing the three possible positions of the element's valve handle.
Figure 10:
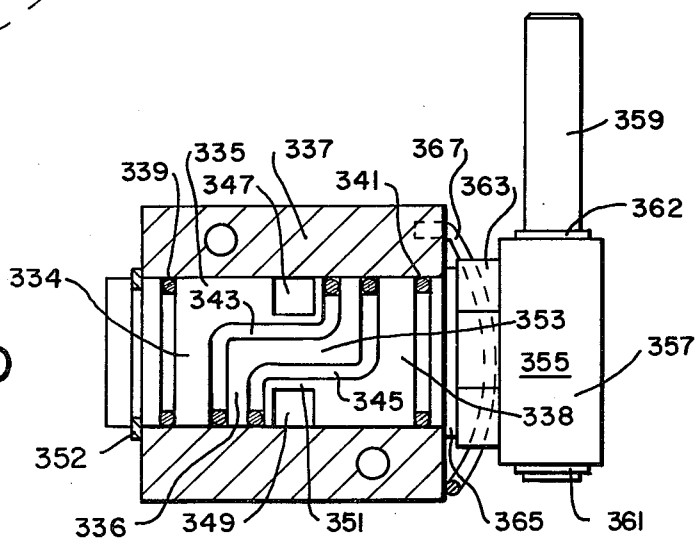
FIG. 10 is a cross-sectional view of a control element of the remote control valve of FIGS. 7 and 9.

FIGS. 10 and 11 show the internal and external configuration of the two end most closed-center valve elements 313 and 321 of the remote control valve. FIG. 10 would also illustrate the internal configuration of the main control valve element 235 since this element is identical to the two end valve elements, except that because there is no closed-center position the double O-rings of the main control valve element 235 are slightly closer together.

Referring to FIG. 10, the valve element is comprised of spool member 335 rotatably disposed in housing 337. The spool member is supported and pneumatically sealed in the housing by end O-rings 339, 341 and the shaped double O-ring pair 343, 345 which is disposed between the two end O-rings. As shown, the shaped O-rings run partially in a circumferential direction about the spool member and partially in an axial direction, and together with the end O-rings 339, 341, create three separate and pneumatically isolated air spaces 334, 336, 338 between the surface of the spool member and the internal surface of the housing. Because of the shape of the center O-rings, the above mentioned three annular air spaces have an irregular configuration with the two end air spaces 334, 338 being axially extended on opposite sides of the spool member. The smaller center air space 336 separates the two end air spaces. Two opposed transverse air channels 347, 349 are formed in spool member 335 midway between the ends thereof. These air channels communicate with the extended portions of the two end air spaces 334, 338, and form a central partition 351 therebetween one side of which is pneumatically isolated from the other. By rotating the partition the pneumatically isolated air channels 347, 349 can be oriented to pneumatically connect any two adjacent air passageways formed in the modular element housing.

As shown, partition 351 has relatively substantial thickness. The end wall 353 of the partition, which will pass over an air passageway as the valve element is rotated, is therefore wide enough to substantially overlap any air passageway over which it might be positioned. The axially directed portions of shaped double O-rings 343, 345 run along the extreme edges of the end wall 353 to pneumatically seal the end wall space from the two adjacent air channels 347, 349. This creates at the end wall a pneumatically closed space or "closed-center" for sealedly closing the overlapped air passageway. Thus, taking, for example, the end or abrasive flow modulating valve element 321 shown in FIGS. 7 and 9, with the valve element in its closed-center position, the overlapped auxiliary air passage means 317 is sealed capturing whatever modulating pressure exists in the modulation pilot line and abrasive flow control valve.

The valve element's spool member 335, which is locked into housing 337 by snap ring 352, is rotated in the housing by a valve element actuation handle 255. Preferably, this actuation handle is comprised of a hub portion 257 secured to the end of the spool member and a short piece metal stock 259 held in a bore running through the hub portion and spool member end by snap rings 361 and 362. To key the actuation handle to the three required rotational positions shown in FIG. 11, an octagon surface 363 is formed on the hub shaft 365 for engaging a U-shaped expansion spring 367. The expansion spring, which is anchored to housing 337, engages opposite flats of the octagon surface and resists turning of the handle until sufficient force is supplied to expand the spring for rotating to the next adjacent flats.

OPERATION OF A FOUR PILOT LINE SYSTEM

To operate a four pilot line system (FIG. 2), manual valve 53 is first turned to the "on" position. The operator then takes hold of the end of the abrasive end of the abrasive blast hose 54 and grips the four pilot line remote control valve (FIG. 7) secured thereto. The remote control valve's valve element 313 for controlling the system's exhaust valve 57 is checked to see that it is in its counter clockwise rotation such that the exhaust valve 57 will be actuated to its closed position when inlet valve 59 is actuated; also in most cases the operator would want the modulation valve element 321 in its closed-center position, at least to commence blasting. The modulation valve element, however, should first be turned to its clockwise rotation position to exhaust any residual modulation pressure which may still be captured in the modulation pilot line (pilot line 3). The operator is now ready to blast, preferably a test piece so that a suitable flow of abrasive media can be set by the systems unique modulation function.

To commence blasting the operator pushes in the detent button 257 of detent element 255 and grips or pulls down on control handle 249 until it is in the position shown in FIG. 9. This pressurizes pilot line 4 (assuming valve element 313 has been turned to its counter clockwise rotation) and 2 for, respectively, closing the system's exhaust valve 57 and opening its inlet valve 59. With the inlet valve open and the exhaust valve closed, holding tank 63 pressurizes and air flow through air line 64 to the abrasive flow control valve 61. The pressurization of pilot line 2 also actuates the normally closed abrasive flow control valve to its "open" condition thereby permitting abrasive media to flow out of the holding tank so that it can be propelled into and through abrasive blast hose 54 by the air flowing in from air line 64. Blasting will build up gradually over the short time it takes to pressurize the holding tank.

When blasting the flow of the abrasive media can be decreased by turning the modulation valve element 321 on the remote control valve to its counter-clockwise rotation. This permits modulation pressure to gradually build up in the flow control valve for gradually reducing the flow of abrasive media from the holding tank. When a suitable abrasive flow is reached, as visually determined by the operator who is all the time watching the test piece, then the operator turns the modulation valve element back to its closed-center position in order to fix the abrasive flow at the level achieved. (There may be a very slight over-shoot from the observed flow due to the capacity of the modulation pilot line.) To increase the abrasive flow the modulation pressure is gradually exhausted through the remote control valve by simply turning the modulation valve element 321 of the remote control valve to its clockwise rotation until a desired increased flow is achieved. The valve element is then returned again to its closed-center position.

If the operator desired to temporarily terminate blasting the control handle 249 is imply released. With valve element 313 in its closed-center position the system's exhaust valve 57 will remain closed so that the holding tank 63 will remain pressurized. Thus, blasting can be instantly reinitiated without having to wait for the holding tank to repressurize. Once a job is finished, the tank is depressurized by turning valve element 313 to its clockwise position.

To air blast the control handle 249 is again depressed to its "on" position. With the control handle in this position, the modulation valve element 331 is turned to its counter-clockwise position until the flow of abrasive media from the holding tank is entirely shut off. If the modulation valve element is then returned to its closed-center position, the air blasting function of the system is maintained even when the control handle is released. The operator can now intermittently air blast by alternatingly releasing and gripping the control handle.

The present invention is a combination abrasive and air blasting system embodying two unique cooperating valves, to wit, a novel abrasive flow control valve and a novel remote control valve. Using the system of the present invention, the flow of the abrasive media can be infinitely modulated by the system's operator or can be entirely shut off for the purpose of switching the system for the abrasive blast function to an air blast function. The abrasive flow control and remote control valves of the system have a unique break-down construction which permits parts to be added, deleted, or interchanged according to the requirements of the system.

Although the present invention has been described in considerable detail in the above specification, it is not intended that the invention be limited to such detail, except as may be necessitated by the appended claims.

What I claim is:

1. An abrasive flow control valve for regulating the flow of abrasive media to the blast nozzle of an abrasive blast system comprising, in combination, a housing having a first and second chamber formed therein, said first chamber having at least one abrasive media inlet port and at least one abrasive media outlet port, and said second chamber adapted to pneumatically communicate with a remotely controllable air supply, a reciprocable plunger assembly extending between said first and second chambers and having first and second ends, the first end of said plunger assembly being disposed to be reciprocated in relation to said abrasive media inlet port for regulating the flow of abrasive media therethrough, the second end of said plunger assembly having a deflectable wall fixedly secured thereto, said deflectable wall forming one of the walls of said second chamber and being adapted to move said plunger assembly for opening said abrasive media inlet port when said second chamber is pressurized by said remotely controllable air supply, means for sealing said plunger assembly to said housing substantially where said plunger assembly passes between said first and second chambers whereby pneumatic integrity is maintained therebetween, said sealing means being adapted to substantially prevent air pressure on said sealing means from being transmitted to said plunger assembly, means for biasing said plunger assembly to a position for keeping said abrasive media inlet valve closed, the biasing force of said biasing means being chosen so that it can be overcome by normal operating pilot pressure in said second chamber, air inlet means for permitting air to be introduced under pressure into said first chamber for propelling abrasive media flowing in through said abrasive media inlet port out through said abrasive media outlet port, and means for modulating the position of said plunger assembly with respect to said abrasive media inlet port when said second chamber is pressurized whereby the flow of said abrasive media in through said abrasive media inlet port can be selectively regulated, said modulation means comprising a variable pressure chamber formed in said housing adjacent said second chamber and having said deflectable wall of said second chamber in common therewith, said deflectable wall being of a relatively large size in relation to the dimensions of said second chamber whereby movement of said plunger assembly is substantially controlled by said deflectable wall by the relative pressures in said second chamber and variable pressure chamber, and modulating air pressure inlet means for controllably pressurizing said variable pressure chamber for modulating the position of said plunger assembly.

2. The abrasive flow control valve of claim 1 wherein said second chamber further includes an emergency exhaust means whereby in the event of malfunction said second chamber can be independently depressurized thereby closing said abrasive media inlet port.

3. The abrasive flow control valve of claim 1 wherein said modulating air pressure inlet means includes a threaded plug having a relatively small air passageway therethrough, said plug being threadedly insertable into an opening in said third chamber substantially opposite the second end of said plunger assembly, the air passageway of said plug being adapted to pneumatically communicate with a remote modulating air supply.

4. The abrasive flow control valve of claim 1 further comprising an abrasive resistant liner removably insertable in said first chamber, said liner having a plurality of spaced openings formed in the walls thereof and being rotatable in said first chamber such that different openings of said plurality of openings can be selectively aligned with said abrasive media outlet port and air inlet port whereby wear at said outlet port caused by abrasive media flowing therethrough occurs substantially only at said resistant liner and whereby when substantial wear occurs at one opening aligned with said outlet port another opening can be rotated in its place.

5. The abrasive flow control valve of claim 4 wherein said first chamber of said housing and said resistant liner are cylindrical in shape and said liner has four openings spaced 90° apart.

6. The abrasive flow control valve of claim 1 including a clean out port in said first chamber and means for releasably sealing said clean out port whereby said first chamber can be readily accessed for cleaning or for observing wear caused by abrasive media flowing therethrough.

7. The abrasive flow control valve of claim 1 wherein said deflectable wall comprises a reinforced pressure diaphragm secured at its outer periphery to said housing and at its center to said plunger assembly.

8. The abrasive flow control valve of claim 7 wherein said deflectable wall comprises a reinforced pressure diaphragm secured at its outer periphery to said housing and at its center to said plunger assembly.

9. The abrasive flow control valve of claim 7 wherein said diaphragm is fabricated from an elastomeric material and is reinforced by metal plates extending from said plunger assembly against opposite sides of said diaphragm, said metal plates being of a size to provide a large rigid pressure reacting surface on both sides of said diaphragm and a relatively small unreinforced flex portion to permit deflection of said diaphragm.

10. The abrasive flow control valve of claim 1 wherein said plunger assembly sealing means includes an O-ring fitted about said plunger assembly and a sealing diaphragm secured between said plunger assembly and housing proximate the first end of said plunger assembly.

11. The abrasive flow control valve of claim 9 including an air relief passage extending entirely through said housing from the air space formed between said O-ring and said sealing diaphragm whereby said air space is exhausted during movement of said plunger assembly.

12. The abrasive flow control valve of claim 10 wherein a filter element is disposed in said air passage means to prevent foreign materials from entering the air space between said sealing diaphragm and O-ring.

13. The abrasive flow control valve of claim 10 wherein said sealing diaphragm is secured to said housing by a bottom liner plate secured in said first chamber, said bottom line plate having a relatively small central opening through which said plunger assembly passes whereby said sealing diaphragm has a small pressure reactive flex portion when compared to said deflectable wall whereby pressure in said first chamber reacting on the flex portion of said sealing diaphragm will have an insubstantial tendency to counteract the closing force of said plunger assembly bias means.

14. The abrasive flow control valve of claim 1 wherein said plunger assembly sealing means includes an O-ring fitted about said plunger assembly and a wiper rod seal secured to said housing and tightly surrounding said plunger assembly proximate the first end thereof.

15. The abrasive flow control valve of claim 7 wherein said plunger assembly comprises a plunger shaft having a first threaded end and a second threaded end, said second threaded end having a reduced cross-sectional dimension such that a shoulder is formed on said plunger assembly shaft, a stopper means threadedly engaged to the first threaded end of said plunger assembly shaft whereby it can be detached for replacement, said stopper means forming the first end of said plunger assembly for regulating the flow of abrasive media through said abrasive media inlet port, said pressure diaphragm having a central bore of a dimension to tightly engage the second threaded end of said plunger shaft, and a nut being provided for threadedly securing said pressure diaphragm against the shoulder on said plunger assembly shaft, and said housing having removable top and bottom caps for accessing, respectively, said first and second chambers of said housing whereby said abrasive flow control valve can be assembled by assembling said plunger assembly and pressure diaphragm in said housing with the caps removed and then securing said caps to said housing.

16. A remote control valve for use in an abrasive blast system having an abrasive flow modulation function comprising a first control element having an air passage inlet means, an air passage outlet means, an air passage exhaust means, and a first valve means for selectively pneumatically connecting said air passage outlet means to either of said air inlet passage or air passage exhaust means, and a second control element having a main air passage means therethrough in pneumatic communication with the air passage outlet means of said first control element and adapted for pneumatic connection with an output pilot line for controllably actuating the abrasive blast system to a blast condition, and further having an auxiliary air passage means, an air passage exhaust means, and a second valve means being adapted to selectively pnematically connect said auxiliary air passage means with either of said main air passage means or said air passage exhaust means or to sealingly close said auxiliary air passage means for capturing pressurized air therein whereby a variably constant air pressure can be maintained through said auxiliary air passage means for actuating said abrasive flow modulation function.

17. An abrasive flow control valve for regulating the flow of abrasive media to the blast nozzle of an abrasive blast system comprising, in combination, a housing having a first and second chamber formed therein, said first chamber having at least one abrasive media inlet port and at least one abrasive media outlet port, and said second chamber adapted to pneumatically communicate with a remotely controllable air supply, a reciprocable plunger assembly extending between said first and second chambers and having first and second ends, the first end of said plunger assembly being disposed to be reciprocated in relation to said abrasive media inlet port for regulating the flow of abrasive media therethrough, and the second end of said plunger assembly having a reinforced diaphragm secured thereto, the output periphery of said reinforced diaphragm being secured to said housing so that said diaphragm forms one of the walls of said second chamber, said diaphragm being of an elastomeric material and having metal reinforcement plates secured against opposite sides thereof, said metal reinforcement plates being of a size to provide a large rigid pressure reacting surface on both sides of said diaphragm and a relatively small unreinforced flex portion to permit deflection of said diaphragm, said diaphragm being adapted to move said plunger assembly for opening said abrasive media inlet port when said second chamber is pressurized by said remotely controllable air supply, means for biasing said plunger assembly to a position for keeping said abrasive media inlet valve closed, the biasing force of said biasing means being chosen so that it can be overcome by a normal operating pilot pressure in said second chamber, means for sealing said plunger assembly to said housing substantially where said plunger assembly passes between said first and second chambers whereby pneumatic integrity is maintained therebetween, said sealing means including an O-ring disposed to sealedly engage said plunger assembly and housing between said first and second chambers, and a sealing diaphragm secured between said plunger assembly and housing proximate the first end of said plunger assembly, said sealing diaphragm being secured to said housing by a bottom liner plate secured in said first chamber, said bottom liner plate having a relatively small central opening through which said plunger assembly passes whereby said sealing diaphragm has a small pressure reactive flex portion when compared to said metal reinforcement plates of said pressure diaphragm whereby pressure in said first chamber reacting on the flex portion of said sealing diaphragm will have an insubstantial tendency to counteract the closing force of said plunger assembly bias means, air inlet means for permitting air to be introduced under pressure into said first chamber for propelling abrasive media flowing in through said abrasive media inlet port out through said abrasive media outlet port, and means for modulating the position of said plunger assembly with respect to said abrasive media inlet port when said second chamber is pressurized whereby the flow of abrasive media in through said abrasive media inlet port can be selectively regulated, said modulation means comprising a variable pressure chamber formed in said housing adjacent said second chamber and having said reinforced pressure diaphragm of said second chamber forming a common wall therewith whereby movement of said plunger assembly is effected by said pressure diaphragm in accordance with the relative pressures in said second chamber and variable pressure chamber, and modulating air pressure inlet means for controllably pressurizing said variable pressure chamber for modulating the position of said plunger assembly.

18. In an abrasive flow control valve having a chamber formed therein wherein said chamber has at least one abrasive media inlet port, at least one abrasive media outlet port, and an air inlet means for permitting air to be introduced under pressure into said first chamber for propelling abrasive media flowing in through said abrasive media inlet port out through said abrasive media outlet port, an abrasive resistant liner removably insertable in said chamber, said liner comprising a plurality of spaced openings formed in the walls thereof and being rotatable in said chamber such that different openings of said plurality of openings can be selectively aligned with said abrasive media outlet port and air inlet port whereby wear at said outlet port caused by abrasive media flowing therethrough occurs substantially only at said resistant liner and whereby when substantial wear occurs at one opening aligned with said outlet port another opening can be rotated in its place.

19. The abrasive flow control valve of claim 17 including a clean out port in said chamber and means for releasably sealing said clean out port whereby said first chamber can be readily accessed for cleaning or for observing wear caused by abrasive media flowing therethrough.

20. The remote control valve of claim 16 wherein said second valve means is comprised of a spool member having a sealedly closed center on its circumference whereby said spool member can be rotated to seal closed said auxiliary air passage means by selectively positioning said closed center thereover.

21. The remote control valve of claim 19 wherein said closed center of said spool member is formed by an O-ring pair disposed about the circumference of said spool member, said O-ring pair being shaped so as to have axially directed portions as well as circumferentially directed portions, and said O-ring pair dividing said spool member circumference into three pneumatically isolated air spaces including a closed center air space and two circumferentially opposed air spaces adjacent thereto which are adapted to pneumatically connect said auxiliary air passage means to either of said main air passage means or said air passage exhaust means.

22. The remote control valve of claim 20 wherein said circumferentially opposed air spaces each include an air channel, said air channels being opposed so that to form a partition therebetween having circumferential end walls, the axially directed portions of said O-rings being disposed to run along the extreme edges of said partition end walls to pneumatically seal said end walls from said air channels whereby the closed centers of said spool member occur at the opposite end walls of said partition and between said opposed air channels.

23. The remote control valve of claim 16 wherein a main control handle is provided to actuate said first valve means and a separate valve actuation handle is provided to actuate said second valve means, said separate control handle and actuation handle being journalled, respectively, to said first and second control elements for convenient, accessible and independent operation by the operator holding said remote control valve.

24. The remote control valve of claim 22 wherein said actuation handle for said second valve means has means for keying same to three rotational positions corresponding to said second valve means being positioned to pneumatically connect said auxiliary air passage means to said main air passage means, said auxiliary air passage means to said air passage exhaust means, and to sealedly close said auxiliary air passage means whereby the operator of said remote control valve can select one of said three rotational positions in accordance to whether he wishes to increase the modulation pilot pressure to said auxiliary air passage means, decrease it, or maintain it at a constant level.

25. The remote control valve of claim 23 wherein said keying means for the actuation handle of said second valve means includes an actuation handle shaft having flats formed therearound proximate the outside of said second control element, and a substantially U-shaped expansion spring surrounding and engaging the flats on said shaft, the ends of said expansion spring being anchored to said second control element whereby, when said expansion spring engages opposite flats, rotation of the actuation handle is resisted until sufficient force is supplied to expand the spring for rotating to the next adjacent flats.

26. The remote control valve of claim 22 wherein said first control element includes a detent element adapted to be actuated by the operator for opening and closing said air passage inlet means and for simultaneously permitting the operator to open said main control handle.

27. A remote control valve for use in an abrasive blast system having an abrasive flow modulation function comprising a first control element having an air passage inlet means, air passage outlet means, air passage exhaust means, and a first valve means for selectively pneumatically connecting said air passage outlet means to either of said air inlet passage or air passage exhaust means, a second control element having a main air passage means therethrough which is in pneumatic communication with the air passage outlet means of said first control element and which is adapted for pneumatic communication with an output pilot line through which said abrasive blasting system can be controllably actuated to a blast condition by actuation of said first valve means, said second control element further having an auxiliary air passage means, an air passage exhaust means, and a second valve means, said second valve means including a spool member having an O-ring pair disposed about the circumference thereof, said O-ring pair being shaped so as to have axially directed portions as well as circumferentially directed portions, and said O-ring pair dividing said spool member circumference into three pneumatically isolated air spaced including a closed center air space and two circumferentially opposed air spaces adjacent thereto, said circumferentially opposed air spaces each including an air channel wherein said air channels are opposed so as to form a partition therebetween having circumferential end circumferential end walls, the axially directed portions of said O-ring being disposed to run along the extreme edges of said partition end walls to pneumatically seal said end walls from said air channels to provide a pneumatically closed center therebetween, said spool member being journalled in said second control element such that it can be rotated to selected positions wherein by means of one of said opposed air channels said auxiliary air passage means can be pneumatically connected with either of said main air passage means or said air passage exhaust means, or wherein said auxiliary air passage means can be sealedly closed by positioning one of the closed center ends of said partition end walls thereover thereby capturing pressurized air in said auxiliary air passage means whereby a variably constant pilot air pressure can be maintained in said auxiliary air passage means for actuating said abrasive flow modulation function.

28. An abrasive blast system comprising, in combination, an abrasive media holding tank having an abrasive media discharge line, means for pressurizing and depressurizing said holding tank including a remotely controllable inlet valve means and a remotely controllable outlet valve means, a remotely controllable, and normally closed abrasive flow control valve in fluid connection with said holding tank discharge line, and having an air inlet line, air flow through which is actuated by said inlet valve means, and an outlet line, said abrasive flow control valve including a pneumatically actuated modulation means whereby the flow of the abrasive media from the said abrasive media holding tank can be modulated according to the requirements of the blasting operation, an abrasive flow directing means extending from the outlet line of said abrasive flow control valve, and a remote control valve disposed for operation by the operator of the abrasive blast system and a multiple of pilot lines pneumatically connecting said remote control valve to said inlet valve means, said outlet valve means, and said abrasive flow control valve, said remote control valve having pneumatic means for actuating said inlet and outlet valve means to remotely pressurize or depressurize said holding tank, and for actuating said abrasive flow control valve, said pneumatic means for actuating said abrasive flow control valve including means for remotely actuating the modulation means thereof.

29. The abrasive blast system of claim 27 wherein there are three pilot lines in pneumatic communication with said remote control valve, the first of said pilot lines being adapted for bringing in pressurized pilot air from a pressurized air supply, the second of said pilot lines pneumatically connecting said remote control valve to said inlet and abrasive flow control valve in a manner such that pressurization of said second pilot line will open both of said valves to provide a flow of abrasive media from said holding tank and a flow of pressurized air through said abrasive flow control valve air inlet line for propelling the abrasive media out through said abrasive flow directing means, and the third of said pilot lines pneumatically connecting said remote control valve to said abrasive flow control valve for pneumatically actuating the modulation means thereof.

30. The remote control valve of claim 28 wherein said second pilot line is also in pneumatic communication with said outlet valve, said outlet valve being in a normally open condition and being remotely actuated to a closed condition by the pressurization of said second pilot line whereby blasting is initiated by pressurizing said second pilot line by means of said remote control valve to simultaneously open said inlet and abrasive flow control valves and close said outlet valve to permit pressurization of said holding tank and whereby blasting is terminated by depressurizing of said second pilot line to simultaneously close said inlet and abrasive flow control valve and close said outlet valve for depressurizing said holding tank.

31. The remote control valve of claim 28 further comprising a fourth pilot line pneumatically connecting said remote control valve to said outlet valve whereby the depressurization of said holding tank is separately controlled from said remote control valve whereby blasting can be initiated and be terminated without repeated hold tank depressurization.

32. The remote control valve of claim 27 wherein said modulation means of said abrasive flow control valve is adapted to reduce the flow of abrasive media from said holding tank to zero flow such that by suitably actuating said remote control valve the flow of abrasive media can be terminated while the abrasive blast system is in the on condition causing the system to operate in an air blasting mode.

33. The abrasive blast system of claim 27 wherein said abrasive flow control valve includes a variable pressure chamber and means for regulating the flow of abrasive media into said abrasive flow control valve from said holding tank in accordance with the pressure in said variable pressure chamber, and said remote control valve including a separate control element for supplying pilot air to said variable pressure chamber, one of said multiple pilot lines pneumatically connecting said separate control element of said remote control valve to said variable pressure chamber of said abrasive flow control valve, said separate control element having a valve means adapted to be actuated for continually pressurizing said variable pressure chamber, continually exhausting same, or for holding any intermediate pressure therein whereby an operator holding said remote control valve can selectively actuate said valve means for selectively modulating the flow of abrasive media into said abrasive flow control valve and out through said abrasive flow directing means.

* * * * *

UNITED STATES PATENT OFFICE

CERTIFICATE OF CORRECTION

Patent No. 4,075,789 Dated February 28, 1978

Inventor(s) George H. Dremann

It is certified that error appears in the above-identified patent and that said Letters Patent are hereby corrected as shown below:

IN THE SPECIFICATION

Col. 6, line 45, "respectfully" should read --respectively--.

Col. 13, line 32, "Air passage" should read --air outlet passage--.

Col. 17, line 38, "desired" should read --desires--.

Col. 17, line 39, "imply" should read --simply--.

IN THE CLAIMS

Claim 11, Col. 19, line 53, "claim 9" should read --claim 10--.

Claim 12, Col. 19, line 58, "claim 10" should read --claim 11--.

Claim 13, Col. 19, line 62, "claim 10" should read --claim 11--.

Claim 17, Col. 21, line 11, "output" should read --outer--.

UNITED STATES PATENT OFFICE
CERTIFICATE OF CORRECTION

Patent No. 4,075,789 Dated February 28, 1978

Inventor(s) George H. Dremann

It is certified that error appears in the above-identified patent and that said Letters Patent are hereby corrected as shown below:

Claim 19, Col. 22, line 25, "claim 17" should read --claim 18--.

Claim 21, Col. 22, line 37, "claim 19" should read --claim 20--.

Claim 22, Col. 22, line 50, "claim 20" should read --claim 21--.

Claim 24, Col. 23, line 1, "claim 22" should read --claim 23--.

Claim 25, Col. 23, line 14, "claim 23" should read --claim 24--.

Claim 26, Col. 23, line 26, "claim 22" should read --claim 23--.

Claim 27, Col. 23, lines 62-63, "circumferential end circumferential end walls," should read --circumferential end walls,--.

Claim 29, Col. 24, line 46 "claim 27" should read --claim 28--.

UNITED STATES PATENT OFFICE
CERTIFICATE OF CORRECTION

Patent No. 4,075,789 Dated February 28, 1978

Inventor(s) George H. Dremann

It is certified that error appears in the above-identified patent and that said Letters Patent are hereby corrected as shown below:

Claim 30, Col. 24, line 62, "claim 28" should read --claim 29--.

Claim 31, Col. 25, line 9, "claim 28" should read --claim 29--.

Claim 32, Col. 25, line 17, "claim 27" should read --claim 28--.

Claim 33, Col. 26, line 3, "claim 27" should read --claim 28--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*